US007014158B2

(12) United States Patent
Berry

(10) Patent No.: US 7,014,158 B2
(45) Date of Patent: Mar. 21, 2006

(54) METHOD AND APPARATUS FOR STORING TOOLS ON A VERTICAL SURFACE IN A BUILDING STRUCTURE IN A NESTED CONFIGURATION THAT FACILITATES THE INSERTION AND REMOVAL OF DIFFERENT SHAPED HAND TOOLS WITHOUT CONTACTING OR DAMAGING THE BUILDING STRUCTURE

(76) Inventor: Robert J. Berry, Box 6122, 6801 E. Stagecoach Pass, Carefree, AZ (US) 85377

( * ) Notice: Subject to any disclaimer, the term of this patent is extended or adjusted under 35 U.S.C. 154(b) by 0 days.

(21) Appl. No.: 10/452,540

(22) Filed: Jun. 2, 2003

(65) Prior Publication Data

US 2004/0238708 A1 Dec. 2, 2004

(51) Int. Cl.
*A47F 5/00* (2006.01)

(52) U.S. Cl. ..... 248/314; 211/70.6; 248/309.1

(58) Field of Classification Search ..... 248/314, 248/311.2, 309.1, 534, 538, 535; 211/70.6, 211/85.18, 68, 65, 69, 69.2, 70.2, 70.8; 403/339, 403/340, 381

See application file for complete search history.

(56) References Cited

U.S. PATENT DOCUMENTS

| | | | | | |
|---|---|---|---|---|---|
| 2,661,920 | A | * | 12/1953 | Gochenour | 248/113 |
| 3,337,058 | A | * | 8/1967 | Sandrick | 211/69 |
| 3,710,997 | A | * | 1/1973 | Asikainen | 224/628 |
| 3,985,324 | A | * | 10/1976 | Larson | 248/220.42 |
| D265,324 | S | * | 7/1982 | Hedgeman | D19/85 |
| 5,232,103 | A | * | 8/1993 | Koenig et al. | 211/69.5 |
| 5,641,079 | A | * | 6/1997 | Schmidt | 211/70.6 |
| 5,979,675 | A | * | 11/1999 | Moriarty | 211/60.1 |
| 6,484,892 | B1 | * | 11/2002 | Gooner | 211/70.6 |
| 6,523,704 | B1 | * | 2/2003 | Sanders | 211/70.6 |

* cited by examiner

*Primary Examiner*—A. Joseph Wujciak
(74) *Attorney, Agent, or Firm*—Tod R. Nissle, P.C.

(57) ABSTRACT

A method and apparatus facilitate the efficient, safe use of storage space in a building structure. The apparatus stores hand tools of differing shape and dimension in a compact area in nested, canted storage units shaped to receive the handles of tools.

1 Claim, 3 Drawing Sheets

FIG.1
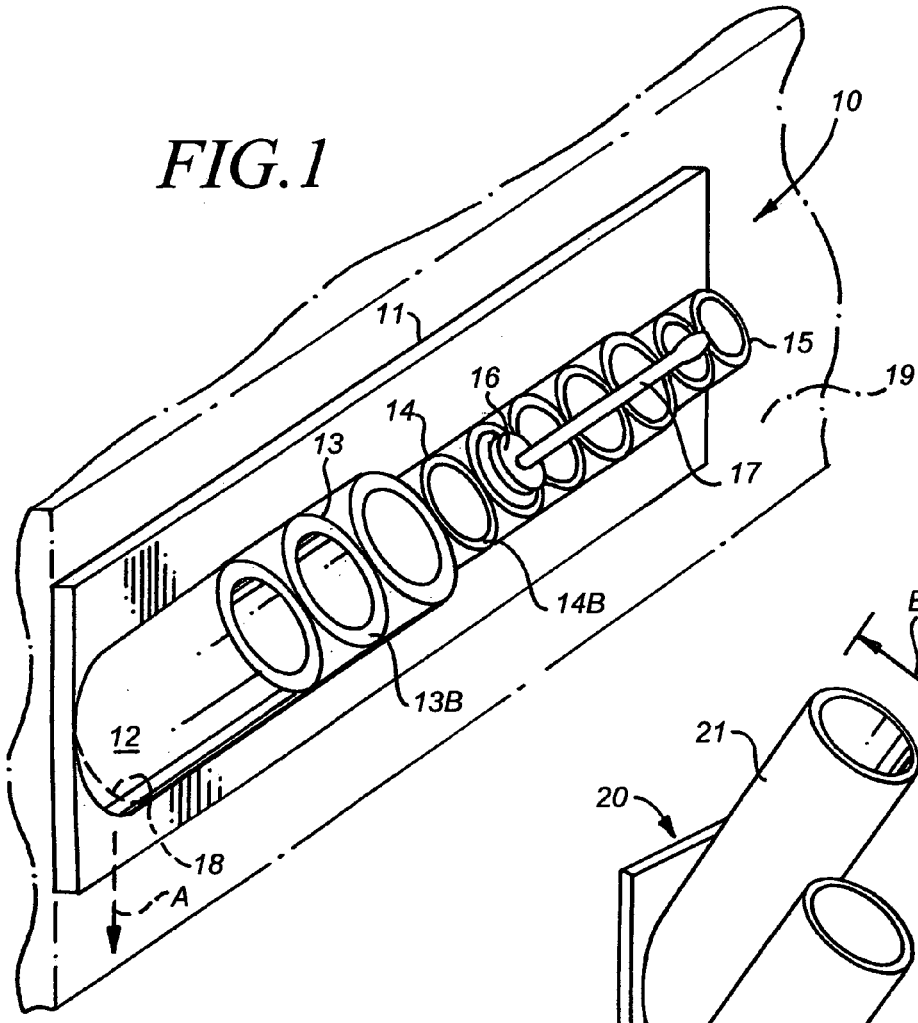
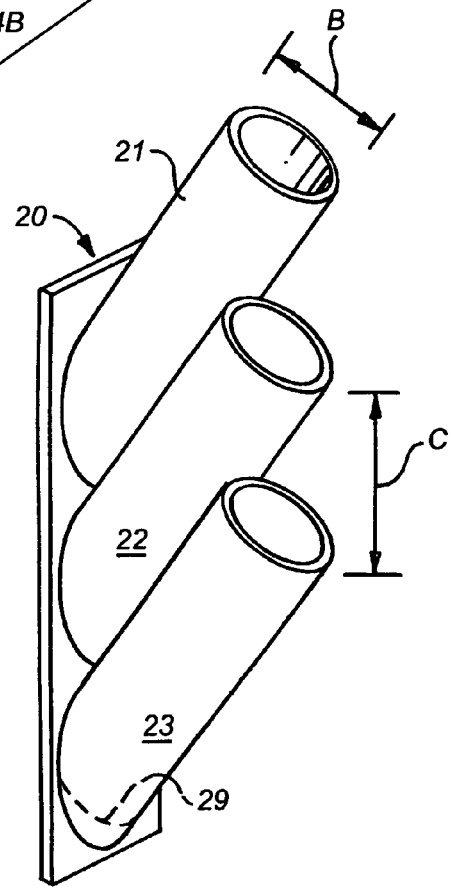
FIG.2

FIG.3
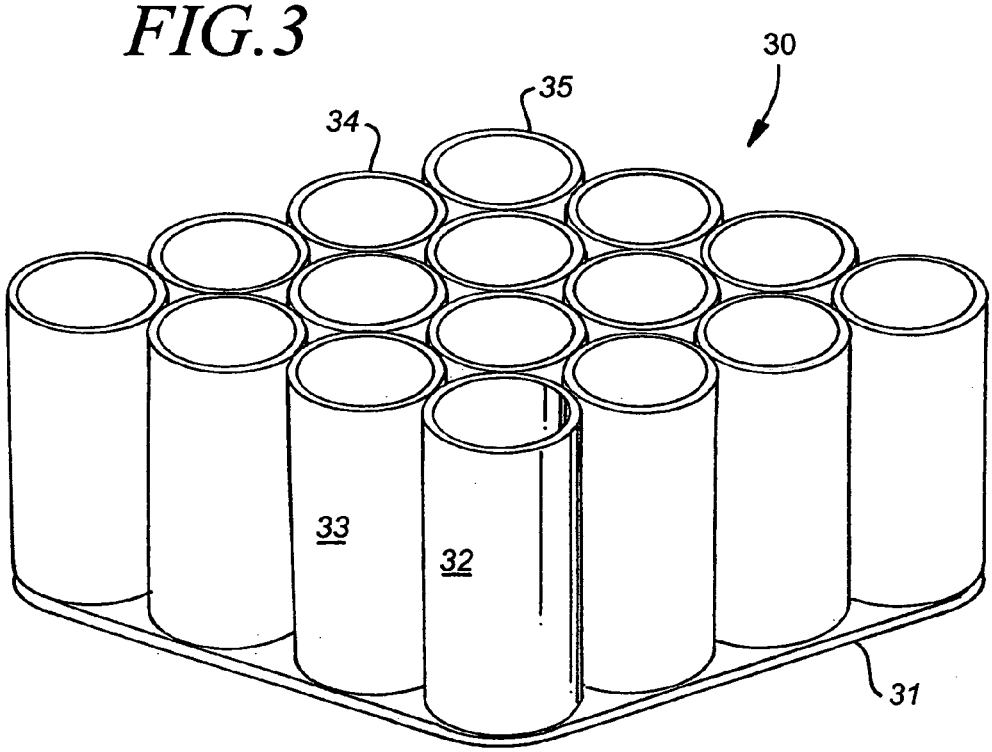
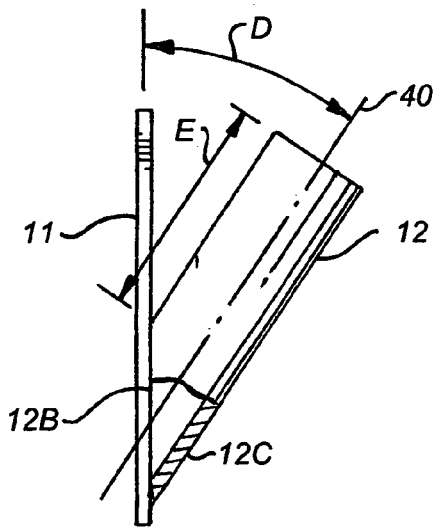
FIG.4

METHOD AND APPARATUS FOR STORING TOOLS ON A VERTICAL SURFACE IN A BUILDING STRUCTURE IN A NESTED CONFIGURATION THAT FACILITATES THE INSERTION AND REMOVAL OF DIFFERENT SHAPED HAND TOOLS WITHOUT CONTACTING OR DAMAGING THE BUILDING STRUCTURE

This invention pertains to a method and apparatus for storing tools indoors on or adjacent a vertical surface in a building structure.

More particularly, this invention pertains to a method and apparatus for storing, prior to use, hand tools, and for facilitating the efficient, safe use of storage space in a building structure.

In a further respect, the invention pertains to a tool storage apparatus that facilitates the suspended storage on a wall of hand tools of differing shape and dimension.

In another respect, the invention pertains to a tool storage apparatus that does not require the use of a perforated "peg board" which must be mounted and used in conjunction with well known prior art systems that use metal loop holder units that receive, for example, the end of a screwdriver, and that include angled legs that are inserted in perforations in a peg board to mount the holder units on the board.

In still a further respect, the invention pertains to a tool storage apparatus that functions to store tools in a canted orientation that facilitates insertion and removal of the tools in and from the apparatus when the apparatus is mounted adjacent a wall.

A variety of tool boxes and other receptacles for storing tools are known in the art. Storage of tools on the wall of a garage or shop or other building structure is often accomplished with a peg board and with holder units. The peg board has a plurality of equally spaced holes that form a grid of columns and rows on the peg board. The peg board is mounted on a wall such that the peg board is spaced away from the wall. The holder units ordinarily are formed from metal. Each holder unit includes a body comprises of one or more loops shaped to receive the end of a screwdriver or to receive another tool. The body of each holder unit is connected to one or more feet. Each foot is bent and is otherwise shaped such that the foot can be inserted in a perforation in the peg board to secure the holder unit in position on the peg board.

The afore-mentioned holder unit—peg board tool storage devices are widely known and used, and unquestionably facilitate the storage of tools. One disadvantage of such storage devices is that they require the mounting of a peg board. Another disadvantage is that the peg board must be mounted such that it is spaced apart from the wall of a garage. This complicates the installation of the peg board. A further disadvantage of holder unit—peg board tool storage devices is that the loops on the holder units typically can only receive a particular type of tool. For example, loops sized to receive the end of a screwdriver usually can not be used to store most other tools. Still another disadvantage of holder unit—peg board storage devices is that it is likely that the user's hand will contact the peg board if the used attempts to wrap his hand around the handle of a tool that is mounted in a holder unit. While such contact normally is harmless, there is a risk that the user can scrape his knuckles on the edges of the holes formed in the peg board. More importantly, contacting the peg board with the user's hands facilitates the spread of contagious diseases like SARS that often are passed from one person to another via the hands.

Still a further disadvantage of holder unit—peg board storage devices is that they often cannot store the handle of a tool. For example, even if the loop on a holder unit is large enough to receive the handle of a screwdriver, the screwdriver likely will pass completely through the loop and will not be retained by the loop. Yet another disadvantage of holder unit—peg board storage devices is that a holder unit mounted on the peg board often is readily dislodged from mounting holes in the peg board when a tool is being removed. The holder unit must then be reinserted in the mounting holes.

Accordingly, it would be highly desirable to provide a method and apparatus for storing hand tools which would facilitate storing tools on a wall in a building structure, which would readily permit the storage of hand tools, which would permit the storage of the handles of hand tools, which could be installed more readily than convention holder unit—peg board storage devices, which would facilitate the insertion and removal of hand tools, and which would reduce the risk that the apparatus would facilitate the spread of contagious diseases.

Therefore, it is a principal object of the instant invention to provide an improved method and apparatus for storing hand tools.

A further object of the invention is to provide a hand tool storage unit that minimizes the likelihood that an individual's hands will contact the unit while inserting and removing tools from the unit.

Another object of the invention is to provide a hand tool storage unit that facilitates the storage of tools by inserting the tool handles in the storage unit, especially when the handle is larger than the remainder of the tool.

Still a further object of the invention is to provide a hand tool storage unit that readily used in conjunction with and installed on a wall.

Still another object of the invention is to provide a hand tool storage unit that minimizes the accumulation by the unit of dirt, dust, and other debris.

Yet another object of the invention is to facilitate the insertion and removal of tools from a storage unit by allowing the tool to assume a canted orientation when being inserted in the storage unit.

Yet a further object of the invention is to facilitate the storage of a plurality of tools in close proximity in a small area.

Yet still another object of the invention is to maximize the number of tools that can be stored on a selected area inside a room in a building such that the room can more readily be used for functions other than storing tools.

These and other, further and more specific objects and advantages of the invention will be apparent from the following detailed description of the invention, taken in conjunction with the drawings, in which:

FIG. 1 is a perspective view illustrating a tool storage unit constructed in accordance with the invention;

FIG. 2 is a perspective view illustrating another embodiment of the tool storage unit of the invention;

FIG. 3 is a perspective view illustrating still another embodiment of the tool storage unit of the invention;

FIG. 4 is a side view of the tool storage unit of FIG. 1 illustrating the mode of operation thereof;

Figure 5:
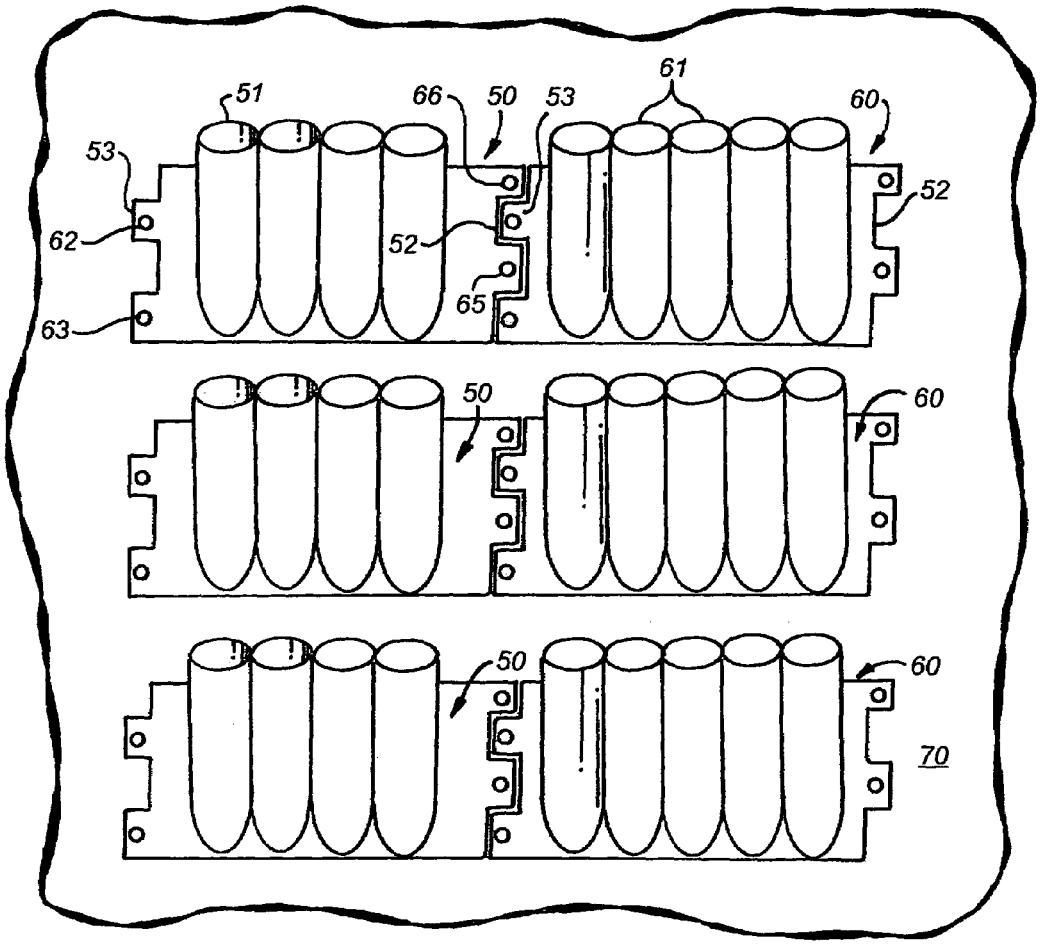
FIG. 5 is a front elevation view illustrating an interlocking embodiment of the tool storage unit of the invention in a tiered configuration; and, FIG. 6 is a top view illustrating still another embodiment of the tool storage unit of the invention.

Briefly, in accordance with my invention, I provide an improved tool storage system. The system includes a building structure; a floor in the building structure; a vertically oriented wall in the building structure; and, a plurality of tool storage elements fixedly mounted above the floor on the wall. Each of the storage elements cants away from the wall; and, is shaped and dimensioned to receive the handle of a tool.

In another embodiment of the invention, I provide an improved tool storage system. The system includes a building structure; a vertically oriented support surface in the building structure; and, a plurality of nested hollow tool storage elements fixedly mounted on the support surface. Each of the storage elements extends upwardly and outwardly from the support surface; includes a proximate end adjacent the support surface; includes a distal end spaced apart from the support surface; includes at least one wall circumscribing and defining an inner storage space, the inner storage space being shaped and dimensioned to receive at least one tool; and, is adjacent at least one of the remaining ones of the storage elements.

In a further embodiment of the invention, I provide an improved method for inserting and removing a tool adjacent a vertically oriented wall structure without contacting the wall structure with the tool or with a hand holding the tool. The improved method includes the step of providing a plurality of hollow tool storage elements. Each of the tool elements includes a proximate end; includes a distal end; includes at least one wall circumscribing and defining an inner storage space, the inner storage space being shaped and dimensioned to receive at least one tool; and, is nested with the remaining ones of the storage elements. The method also includes the step of mounting the hollow tool storage elements on the vertically oriented wall structure such that the elements each extend upwardly and outwardly from the wall structure; such that the proximate end of each of the elements is adjacent the wall surface; and, such that the distal end of each of the elements is spaced apart from the wall surface. The method also includes the step of inserting the handle of a tool in one of the hollow tool storage elements such that the tool cants outwardly away from the wall structure.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a tool storage system constructed in accordance with the invention and including a vertically oriented wall 19 in a room in a building structure. The tool storage system can also, as would be appreciated by those of skill in the art, be mounted on the inside or outside of a door or to any other vertically oriented surface. Wall 19 upwardly depends from a horizontally oriented floor in the building structure (not shown). Base 11 is fixedly secured to wall 19 above the floor with screws, nails, adhesive, or any other desired fastening means. A plurality of hollow cylindrical tool storage units 13, 14, 15 are secured to base 11. The proximate end of each unit 13, 14, 15 is connected to base 11. The distal end 13B, 14B of each unit is spaced apart from wall 19. Each unit 13, 14, 15 cants away from base 11 and wall 19 in the manner illustrated in FIG. 1.

Each unit 13, 14, 15 is canted at an angle D (FIG. 4) with respect to base 11 and wall 19. Angle D can vary as desired, but is in the range of ten degrees to forty-five degrees, preferably twenty degrees to thirty-five degrees. Angles greater than forty-five degrees are not preferred for several reasons. First, when angle D exceeds forty-five degrees, the torque generated by a tool on a unit 13, 14, 15 increases. Second, a tool stored in a unit 13, 14, 15 is more likely to fall out inadvertently or to be knocked out inadvertently. Third, tools portions extending outwardly from units 13, 14, 15 pose an increased risk of injury. Angles less than ten degrees are not preferred because it is difficult to insert and remove a tool in and from a unit 13, 14, 15 with contacting base 11 or wall 19 with the tool or with the hand of the user.

The shape and dimension of each unit 13, 14, 15 can vary as desired as long as each unit 13, 14, 15 functions to receive a desired portion, preferably but not necessarily the handle, of a tool. For example, a unit 13 can have a hexagonal shape instead of a cylindrical shape.

If desired, a portion of the proximate end of unit 12 can be removed by cutting along dashed line 18 (FIG. 2). This would create an opening at the bottom of unit 12 that would permit dirt and debris to fall downwardly out of unit 12 toward the floor.

The inner diameter or width of a unit 12, 13, 14, 15 can vary but is preferably in the range of one-quarter inch to two inches, preferably one-half inch to one and one-half inches.

Figure 6:
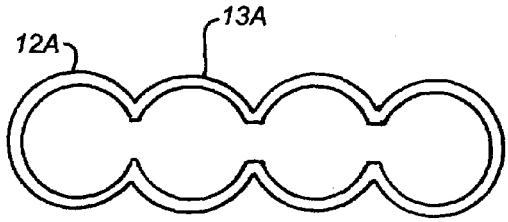

In FIG. 1, units 12, 13, 14, 15 are nested together such that each unit 12, 13, 14, 15 contacts another adjacent unit 12, 13, 14, 15. This facilitates storing a plurality of tools in a small area. Units 12, 13, 14, 15 need not touch in order to be in the preferred nesting configuration of the invention. Units 12, 13, 14, 15 can be spaced apart. If, however, units 12, 13, 14, 15 are spaced apart more than one-half inch from each other, units 12, 13, 14, 15 are no longer deemed to be nested for purposes of defining the invention. As illustrated in FIG. 6, adjacent units 12A and 13A can deemed nested when portions of the wall(s) separating units 12A and 13A are omitted or removed. Units 12A and 13A still circumscribe and define a storage space, but some of the material intermediate units 12A and 13A is removed to reduce the cost of material required to produce nested units 12A and 13A. Nested units 12A and 13A function in accordance with the invention to promote the storage of multiple tools in a small area.

The height E (FIG. 4) of a tube 12, 13, 14, 15 can vary as desired, but is presently in the range of one to six inches, preferably one and one-half to three inches. The bottom surface 12B of a tube 12 is canted with respect to centerline 40 and is not normal to centerline 40. A canted bottom surface 12B facilitates the capture or lodgment of an end of a tool between surface 12 and the side wall 12C of a tube 12.

FIG. 2 illustrates another nested configuration of units 21, 22, 23. In contrast to the nested configuration illustrated in FIG. 1, in the nested configuration of FIG. 2, units 21 to 23 are stacked one on top of the other. The inner diameter B of each unit 21 to 23 is in the range of one-quarter inch to two inches, preferably of one-half inch to one and one-half inches. The distance C from the lower edge of one unit 23 to the lower edge of the adjacent unit 22 is preferably in the range of one-quarter inch to three inches.

If desired, a portion of the proximate end of a unit 12 can be removed by cutting along dashed lines 18, 29 (FIG. 2). This creates an opening at the bottom of unit 12 that would permit dirt and debris to fall downwardly out of unit 12 toward the floor.

FIG. 3 illustrates a further embodiment 30 of nested units 32 to 35 constructed in accordance with the invention. Vertically oriented units 32 to 35 upwardly depend from diamond-shaped base 31. The weight of tools placed in units 32 to 35 helps to stabilize embodiment 30. The close proximity of units 32 to 35 to each other facilitates the storage of multiple tools in a small area. Kitchen utensils, artist's brushes, cosmetic brushes and other articles can be stored in embodiment 30 or in other embodiments of the invention depicted herein.

In FIG. 5, the panel-shaped base of unit 50 includes U-shaped opening 52 and U-shaped tongue 53. Opening 52 received U-shaped tongue 63 of the panel-shaped base of unit 60. The base of unit 60 also includes U-shaped opening 62. Tongues 53 and 63 are of equal shape and dimension. Openings 52 and 62 are of equal shape and dimension. Screws inserted through apertures 62 to 65 can be utilized to secure a unit 50 to a wall 70 or other surface. Any desired fastening system can be used to mount a unit 50 on a vertically oriented surface. The distance from aperture 62 to aperture 66 can be selected such that when the studs of a wall are sixteen inches apart on center, apertures 62 and 63 align with a first vertically oriented stud and apertures 65, 66 align with a second stud that is parallel to and spaced sixteen inches (or some other distance) from the first stud. Such an alignment facilitates the installation of a unit 50 on a wall.

FIG. 6 illustrates a plurality of nested adjacent units 12A, 13A. Each adjacent pair of units 12A, 13A has an opening interconnecting the pair, i.e., a portion of the wall intermediate the pair is removed.

Having described my invention in such terms as to enable those of skill in the art to make and practice it, and having described the presently preferred embodiments thereof, I claim:

1. A tool storage system comprising (a) a building structure;

(b) a vertically oriented wall in said building structure;

(c) a floor in said building structure;

(d) at least first and second tool storage units mounted side-by-side above said floor on said wall, each unit including (i) a base having a first side with a tongue and a second side with a U-shaped opening, said opening of said first unit receiving said tongue of said second unit, (ii) a horizontally oriented nest of hollow tubular side-by-side interconnected tool storage elements fixedly mounted on and extending outwardly from said base, each of said elements (A) including a cylindrical wall, said wall of one of said storage elements connected to the wall of said storage elements immediately adjacent said one of said storage elements, (B) including a mouth, said mouths of said storage elements generally lying in a common plane parallel to a horizontally oriented line, (C) canting away from said wall; and (D) shaped and dimensioned to receive the handle of a tool such that a portion of the tool is prevented from extending laterally past said mouth of said element.

* * * * *